US006033019A

United States Patent [19]

Hession-Kunz et al.

[11] Patent Number: 6,033,019

[45] Date of Patent: Mar. 7, 2000

[54] FEEDING SEAT

[75] Inventors: Elizabeth M. Hession-Kunz, Concord; Kyle A. Nanna, Westwood; Bryan R. Hotaling, Arlington; Jon R. Rossman, Chelmsford, all of Mass.

[73] Assignee: The First Years Inc., Avon, Mass.

[21] Appl. No.: 09/176,585

[22] Filed: Oct. 21, 1998

[51] Int. Cl.[7] ..... A47C 1/08

[52] U.S. Cl. ..... 297/250.1; 297/256.13; 297/256.11; 297/254; 297/338; 297/327

[58] Field of Search ..... 297/250.1, 254, 297/256.1, 256.11, 256.13, 256.15, 256.16, 344.12, 344.14, 467, 338, 327

[56] References Cited

U.S. PATENT DOCUMENTS

| | | | |
|---|---|---|---|
| D. 330,842 | 11/1992 | Meeker et al. . | |
| 628,166 | 7/1899 | Sheridan . | |
| 3,948,556 | 4/1976 | Hyde et al. . | |
| 4,058,342 | 11/1977 | Ettridge . | |
| 4,288,123 | 9/1981 | Cone . | |
| 4,762,364 | 8/1988 | Young . | |
| 4,854,638 | 8/1989 | Marcus et al. | 297/256.11 |
| 4,938,603 | 7/1990 | Turner et al. . | |
| 4,951,997 | 8/1990 | Kenney . | |
| 4,971,389 | 11/1990 | Staggs et al. . | |
| 5,172,955 | 12/1992 | Freese et al. . | |
| 5,238,292 | 8/1993 | Golenz et al. . | |
| 5,364,137 | 11/1994 | Shimer . | |
| 5,380,062 | 1/1995 | Nania . | |
| 5,474,355 | 12/1995 | Lerner et al. | 297/256.11 X |
| 5,507,550 | 4/1996 | Maloney . | |
| 5,609,393 | 3/1997 | Meeker at al. | 297/256.13 |
| 5,681,082 | 10/1997 | Drexler . | |
| 5,746,478 | 5/1998 | Lumley et al. . | |

FOREIGN PATENT DOCUMENTS

| | | |
|---|---|---|
| 4106 | 12/1890 | United Kingdom . |
| 464806 | 4/1937 | United Kingdom . |

*Primary Examiner*—Laurie K. Cranmer
*Attorney, Agent, or Firm*—Fish & Richardson P.C.

[57] ABSTRACT

A child's feeding seat includes a base, a tiltable seat for holding a child, and a removable feeding tray. The base has a bottom surface for supporting the seat upon a horizontal support. The tiltable seat includes a seat frame with a back portion and a pair of side arms, with the seat frame attached to the base in one of a series of selectable tilt positions, and a bottom portion attached to the seat frame at one of a series of selectable positions for adjusting the height of the bottom portion with respect to the back portion of the seat frame. The feeding tray is adapted to be removably attached to both of the side arms of the seat frame. The base includes a pair of spaced apart slots for receiving a strap to secure the seat base to the horizontal support, such as a dining chair.

17 Claims, 6 Drawing Sheets

FEEDING SEAT

BACKGROUND OF THE INVENTION

This invention relates to seats for retaining and supporting a child during feeding.

As children grow and develop over the first few years of their lives, their needs change. It is desirable to have a single feeding seat that can be adapted to meet their changing size and needs.

Children normally begin accepting solid food from a spoon between about four and six months of age. However, the stomach, back and neck muscles of such infants are not yet sufficiently developed and coordinated that the child can remain comfortably erect in an upright chair, even when strapped in with a waist belt. Such young children are therefore commonly fed in a reclined position, with their heads supported. As the child matures, the preferred angle of recline may change.

Older children, such as toddlers of age one to three years, are able to sit erect and feed themselves more or less by hand. Such children may be comfortably seated in high chairs or "booster" chairs, with or without attachable trays to hold food and help prevent spills. The preferred elevation of the child, with respect to the tray or an adjacent table, is apt to change as the child grows. An example of an adjustable high chair designed to be adjusted is disclosed in co-pending patent application Ser. No. 08/938,506, the content of which is incorporated herein by reference as if fully set forth.

SUMMARY OF THE INVENTION

The invention features a portable child's feeding seat that is adaptable to a small child's changing needs, enabling both the reclined feeding of very young infants and the upright feeding of older infants at selectable elevations.

According to one aspect of the invention, the feeding seat includes a base, a tiltable seat for holding a child, and a removable feeding tray. The base has a bottom surface for supporting the seat upon a horizontal support. The tiltable seat includes a seat frame with a back portion and a pair of side arms, with the seat frame attached to the base in one of a series of selectable tilt positions, and a bottom portion attached to the seat frame at one of a series of selectable positions for adjusting the height of the bottom portion with respect to the back portion of the seat frame. The feeding tray is adapted to be removably attached to both of the side arms of the seat frame.

Preferably, the base includes a pair of spaced apart slots for receiving a strap to secure the seat base to the horizontal support, which may be, for instance, a dining chair. More preferably, the base also includes means to secure the seat base to the back of the dining chair.

In some embodiments, the bottom portion of the tiltable seat has a raised crotch restraint projecting from its upper surface between the legs of a child seated in the seat, for keeping the child from sliding forward on the seat.

In some cases the seat also includes a seat belt attached to the seat frame, for securing a seated child to the seat. In a presently preferred embodiment, the seat belt extends through a pair of slots defined in the back portion of the seat frame.

In some embodiments, the base and seat frame each have a pair of arcuate surfaces, the arcuate surfaces of the seat frame arranged to bear against the arcuate surfaces of the base with the seat frame in any of its selectable tilt positions.

In one preferred instance, the seat frame includes both a pair of flanges adjacent its pair of arcuate surfaces, and a movable tab extending from the seat frame; the base defining both a pair of arcuate channels for receiving the pair of flanges of the seat frame, and a slot for receiving the movable tab of the seat frame. The slot has a series of indentations for retaining the tab of the seat frame in any of a number of selectable locations along the slot for fixing the tilt position of the seat frame. The movable tab may have, for instance, a unitary molded plastic cantilever extending from the seat frame and adapted to be moved between base slot indentations by elastically bending the cantilever with respect to the seat frame.

In some embodiments, the feeding tray includes two clips, the side arms of the seat frame each defining multiple recesses for receiving the clips of the feeding tray to retain the feeding tray in any one of a series of selectable positions with respect to the back portion of the seat frame. In one preferred case, the clips are formed of molded plastic, each clip having a pair of raised pegs extending in opposite directions along a common axis, a manipulable handle, and a cantilevered spring portion extending from the clip to bear against the tray as the clip is pivoted about the pegs and to bias the clip toward an engaged position; the tray defining two pair of spaced apart apertures for receiving the pegs of the clips.

In some embodiments, the bottom portion of the pivotable seat has both a pair of ribs extending from opposite sides of the bottom portion, and a tab extending from a rear edge of the bottom portion. The side arms of the seat frame each define a series of selectable slots for receiving a corresponding one of the ribs of the bottom portion at differing bottom portion elevations, and the back portion of the seat frame defines a series of selectable slots for receiving the tab of the bottom portion at differing bottom portion elevations.

The tray preferably has an upper surface that defines a broad recessed region bounded by a lip for intercepting spilled liquids.

The seat frame, the base, the bottom portion and the tray are all preferably formed of molded plastic.

Preferably, the seat frame is attached to the base at a sliding interface, and is adapted to pivot with respect to the base about a pivot point which is disposed above the sliding interface.

According to another aspect of the invention, a child's feeding seat includes a base and a tiltable seat for holding a child. The base has a bottom surface for supporting the seat upon a horizontal support, and defines a pair of spaced apart slots for receiving a strap to secure the seat base to the horizontal support. The tiltable seat includes a seat frame with a back portion and a pair of side arms, with the seat frame attached to the base in one of a series of selectable tilt positions, and a bottom portion attached to the seat frame at one of a series of selectable positions for adjusting the height of the bottom portion with respect to the back portion of the seat frame.

This aspect of the invention includes, in various embodiments, one or more of the features discussed above with respect to the first aspect.

The feeding seat described herein can advantageously adapt to the changing feeding needs of small children, generally from ages 4 months to 3 years or more. The reclining structure of the seat enables hand feeding of younger infants, and the adjustable height and tray features combine to enable feeding of older infants in a variety of positions. That it may be readily secured to a chair or other elevated support also gives the feeding seat some of the beneficial characteristics of a "booster" seat, for feeding older children at table. Advantageously, the seat can be reclined to various positions while the base of the seat remains securely attached to its supporting structure.

Other features and advantages of the invention will become apparent from the following detailed description, and from the claims.

DESCRIPTION OF EMBODIMENTS

Figure 1:
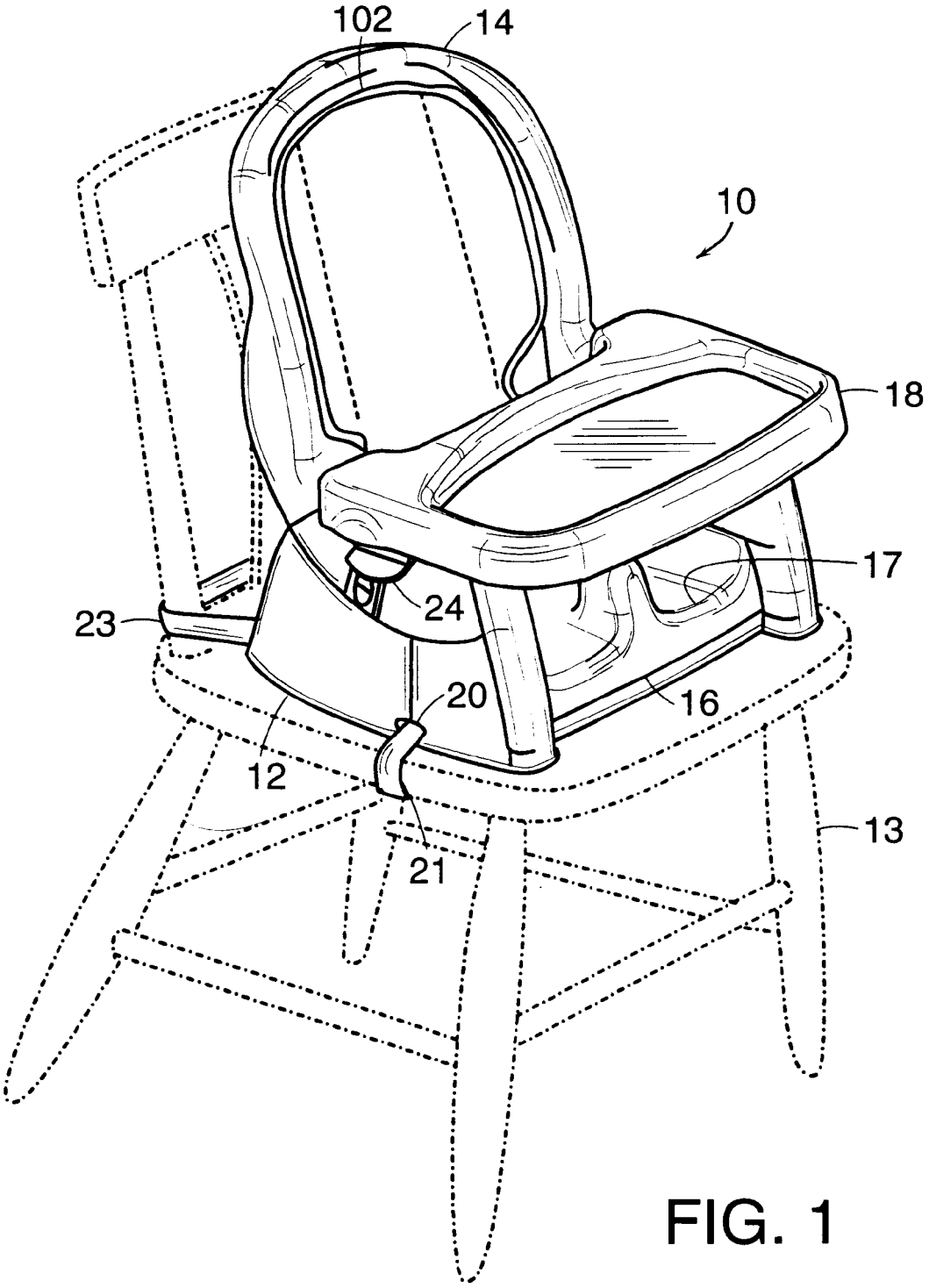
FIG. 1 is a front perspective view of a first feeding seat embodiment, shown mounted to a chair.
Figure 2:
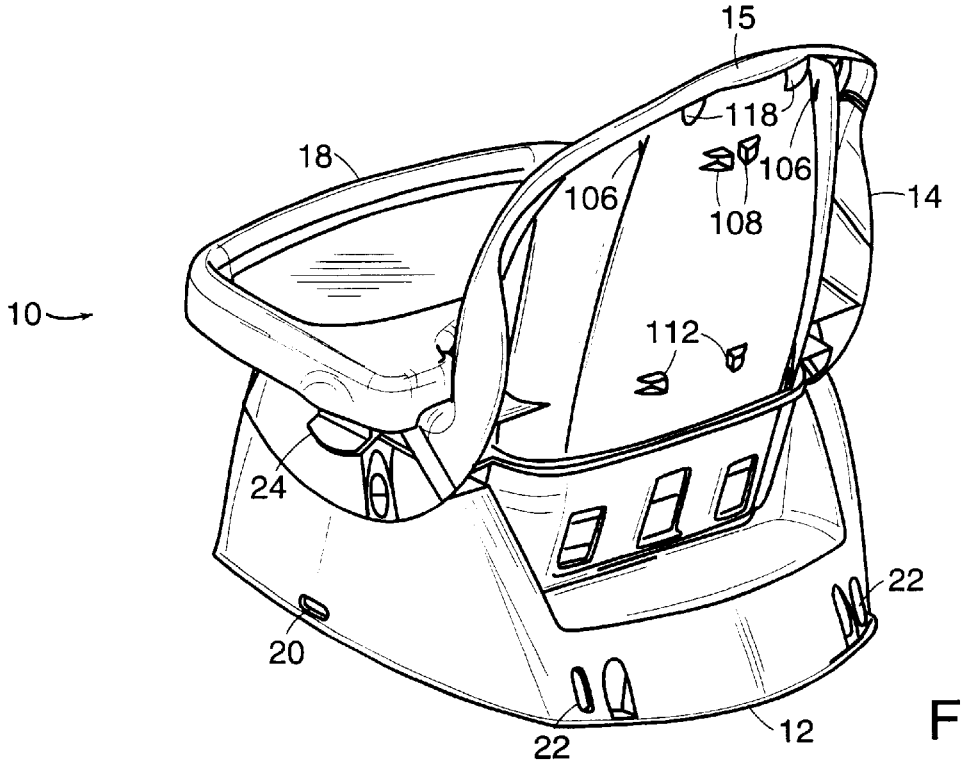
FIG. 2 is a rear perspective view of the feeding seat, with the seat back cushion removed.

FIGS. 1 and 2 illustrate one embodiment of the feeding seat 10, having a base 12, a reclining seat frame 14, a height-adjustable seat bottom 16, and a removable feeding tray 18. A pair of slots 20 in the sides of base 12, and a pair of slots 22 in the back of base 12, enable the seat base to be safely secured to a chair or other supporting structure with straps 21 and 23. It is preferred that, when used with older infants, the feeding seat be strapped both to the seat and back of a standard dining chair 13, as shown in FIG. 1. A pair of manipulable clips 24 secure tray 18 to the arms of the seat frame when the tray is used. The entire seat (less cushion 102 and straps 21 and 23) is formed of molded, impact-resistant plastic. The upper lip 15 of seat back 14 between reinforcing ribs 118, shown in FIG. 2, functions as a handle for lifting the assembled seat.

Figure 3:
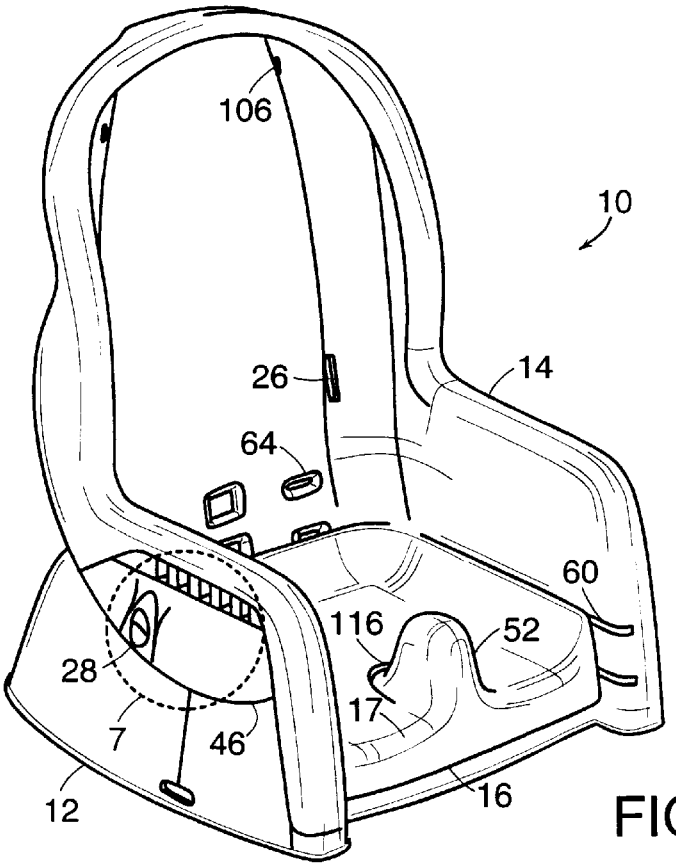
FIG. 3 is a perspective view of the feeding seat of FIG. 1 with the tray removed.

Seat 10 may be used without tray 18, as shown in FIG. 3. In this case, the child is strapped into the seat with a restraining belt (not shown) inserted through a pair of slots 26 at the edges of the contoured back of the seat. A crotch strap (also not shown) extends from the restraining belt through a slot 116 (FIG. 3) in the seat bottom. It is recommended that the belt and strap also be employed when the tray is attached.

For feeding older children at table, the occupied seat, secured to a standard dining chair, is moved into place adjacent a dining table. The height of the chair is adjustable to suit tables of different heights by moving seat bottom 16, as described in more detail below. The size of the bottom footprint of base 12 is selected to accommodate a broad variety of standard dining chairs. In this particular embodiment, the base footprint is 15.5 inches in width and 16.75 inches in depth. In addition, the front edge 17 of the leg channels of seat bottom 16 should be no more than about 4.5 inches above the bottom of base 12, in order to accommodate the relative heights of most dining tables (with aprons) and dining chairs. The height of front edge 17 above the bottom of base 12 in the illustrated embodiment is adjustable from 2.0 inches to 3.5 inches.

Figure 4:
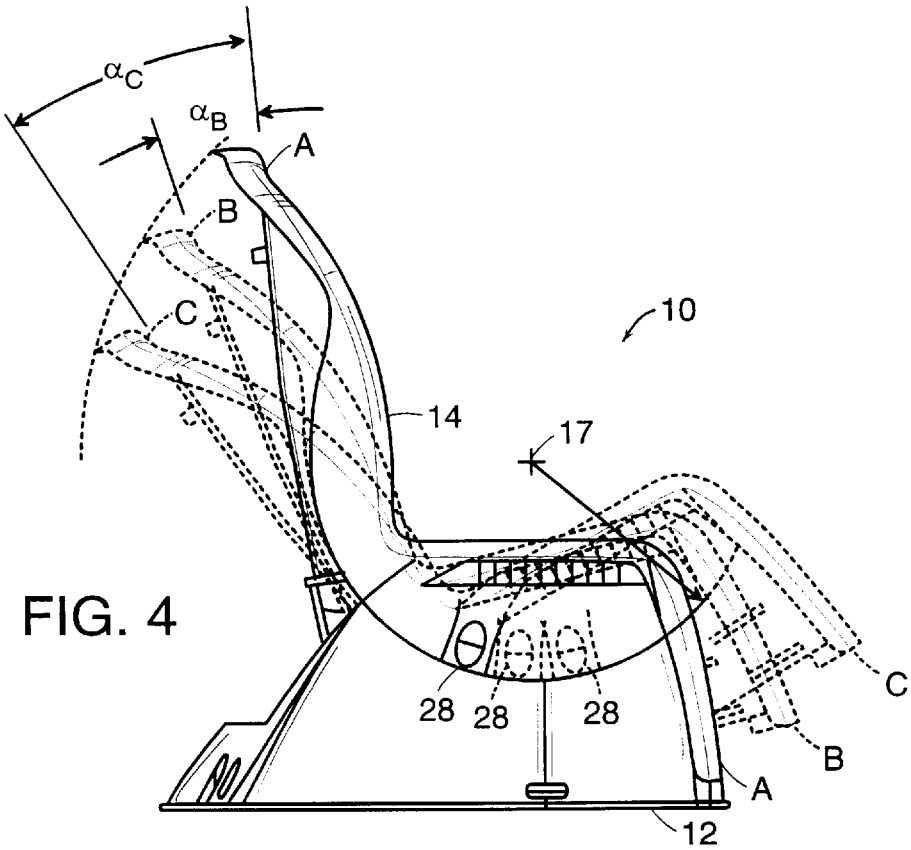
FIG. 4 is a side view of the feeding seat, indicating various tilt positions.

Referring also to FIG. 4, for hand-feeding infants the occupied seat may be reclined from upright position "A" (which is inclined at an angle of 10 degrees from vertical) to either of two tilt positions "B" and "C" by depressing buttons 28 on either side of seat frame 14 and reclining the seat frame into the desired tilt position. Tilt latches operable by depressing buttons 28 secure the seat frame in any of the positions shown in FIG. 4. Base 12 remains stationary and strapped to its support while seat frame 14 is tilted. Tilt position "C" is reclined an angle $\alpha_C$ of about 30 degrees from upright position "A", and is suitable for hand-feeding infants from about four months of age who need some head support while feeding. Although a maximum tilt angle (from position "A") of only about 30 degrees is preferred, tilt angles of up to about 45 degrees from vertical may be employed. Intermediate tilt position "B" is reclined at an angle $\alpha_B$ of about 15 degrees from upright position "A", and is appropriate for feeding infants who need only a slight amount of head support, such as is typical of children of six to eight months of age. Back portion 14 is preferably long enough to provide proper head support for at least the 90th percentile 8 month old infant. Seat frame pivots about a pivot point 17 which is substantially elevated above the seat bottom and the attachment of the seat frame to the base, thereby limiting the rearward motion of the top of the seat back as the seat is reclined. Such rearward motion limitation helps to avoid interference with the back of a supporting chair, for instance.

Figure 5:
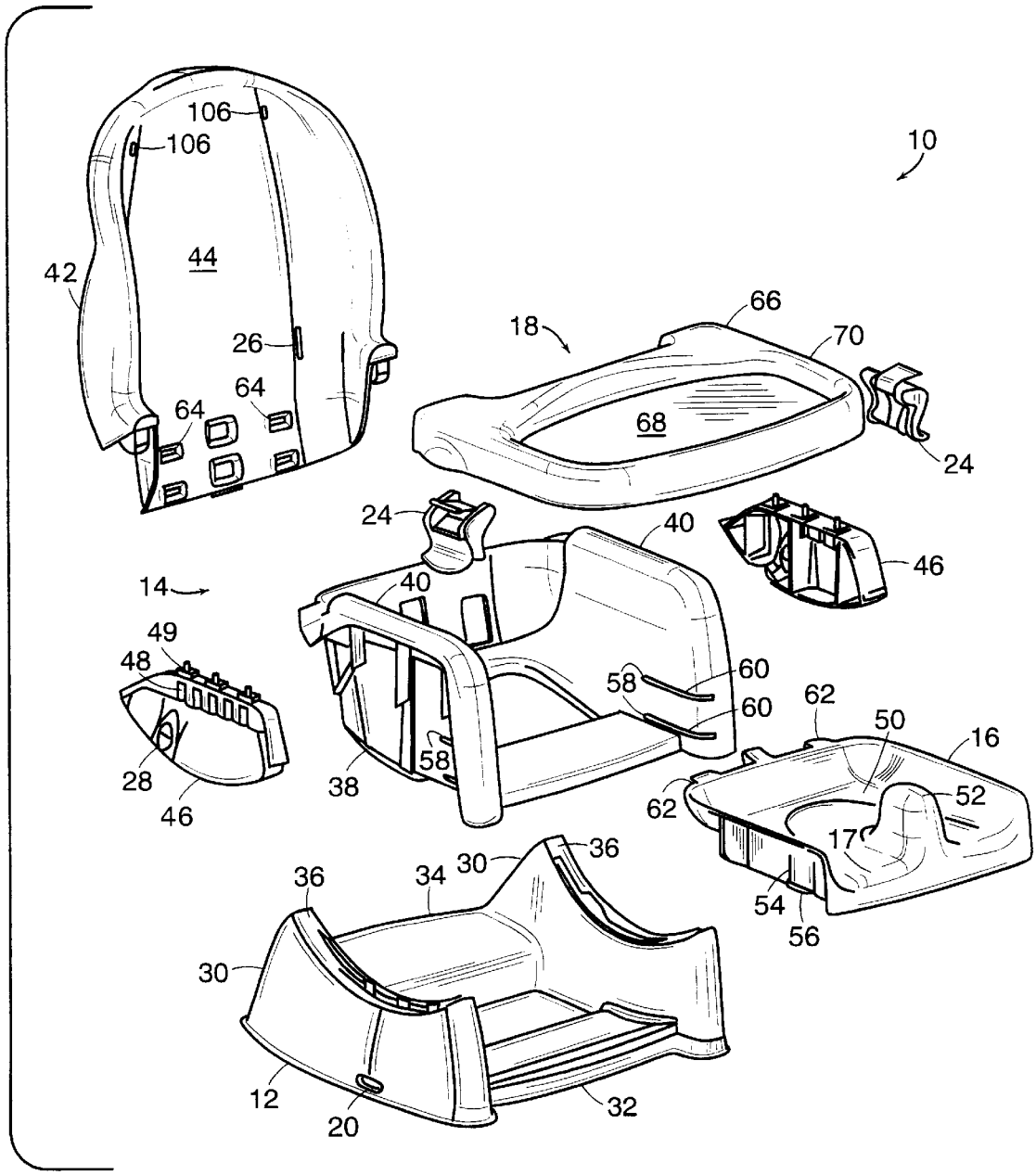
FIG. 5 is an exploded view of the feeding seat of FIG. 1.

FIG. 5 illustrates more of the structural features of the various components of seat 10. For instance, base 12 is a unitary injection molded piece of hard plastic material and consists of two side bulkheads 30 connected by front and rear cross members 32 and 34, respectively. The upper surfaces 36 of side bulkheads 30 are curved to follow parallel circular arcs when viewed from the side.

Seat frame 14 consists of a chassis 38 having twin arms 40, a back portion 42 with a recessed inner surface 44 which is contoured to support a younger infant of 4 to 6 months of age, and two side panels 46 having tilt release buttons 28 and defining tray clip recesses 48. Side panels 46, back portion 42 and chassis 38 are each unitary injection molded pieces of hard plastic material, and are provided with appropriate interconnecting features, such as pins 49 of side panels 46, to be snapped together without tools. Once assembled, seat frame 14 is intended to remain assembled over the useful life of the seat, but may be disassembled for storage, cleaning or transportation.

Seat bottom 16 is also a unitary injection molded piece of hard plastic material, with an upper surface 50 contoured to fit the buttocks and thighs of the seated child. A passive crotch restraint 52 extends at least two inches upward from surface 50 between the child's legs to keep the seated child from "submarining" or slipping out of the seat if not securely strapped in. Vertical cantilevered spring clips 54 at the sides of the seat bottom near the front of the seat have outwardly projecting tabs 56 that engage one of two pairs of corresponding slots 58 at differing elevations in seat chassis 38. As the seat bottom is slid in place in chassis 38, tabs 56 follow shallow channels 60 in the side walls of the chassis, bending clips 54 inward until tabs 56 snap into place in slots 58 contiguous with channels 60. The seat bottom is removed by pressing tabs 56 inward and sliding the seat bottom forward. Three tabs 62 along the rear edge of seat bottom 16 engage one of two sets of corresponding slots 64 in back portion 42

Tray 18 includes a broad tray body 66 and two clips 24. All three components of tray 18 are unitary injection molded pieces of hard plastic material. The vast majority of the area of the upper surface of tray body 66 forms a flat, recessed region 68 surrounded by a raised lip 70 for keeping spills on the tray.

Figure 6:
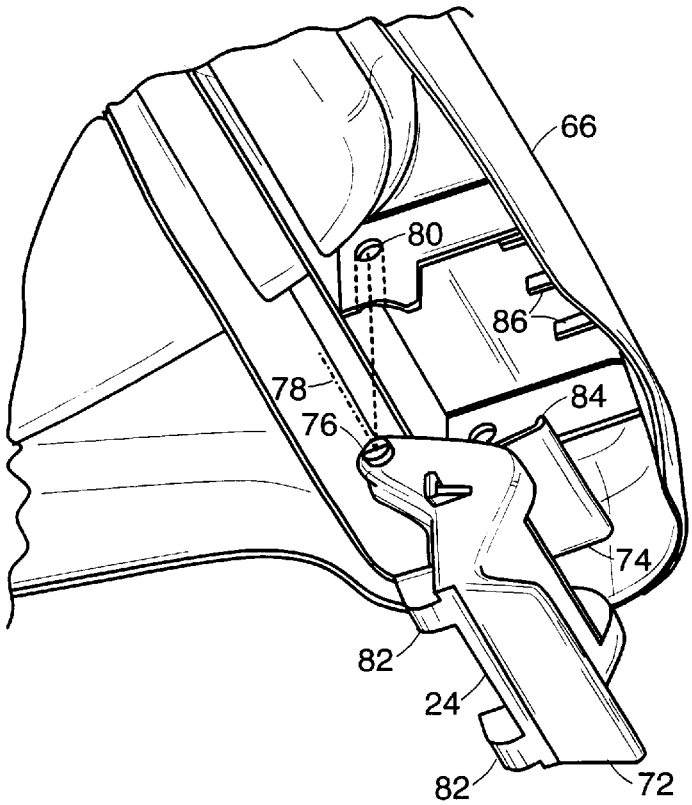
FIG. 6 is an enlarged, exploded underside view of one end of the tray, showing the attachment of the tray clips.

FIG. 6 illustrates the structure of the tray clips 24 and the interface between the clips and tray body 66. Each clip 24 is molded to include an integral handle 72, an integral cantilever spring plate 74, and a pair of pegs 76 (one shown) protruding along a common axis 78 in opposite directions from the ends of the clip. Clips 24 are installed on tray body 66 by inserting pegs 76 into a pair of corresponding holes 80 in reinforcing ribs within the tray body. Chamfers on the upper edges of pegs 76, and tapered channels on the inner sides of the reinforcing ribs leading up to holes 80 facilitate installation. As an alternative to holes 80, contoured slots (not shown) may be provided in the reinforcing ribs to provide a snap fit and rotatable connection for pegs 76. Each clip 24 also has two molded pawls 82 extending inward for engaging the clip recesses 48 of the side panels of the seat frame (FIG. 5). Because peg axis 78 is located inboard of pawls 82, in combination with the angle of the latching pawl surface, the latches are urged toward their latching position as the installed tray is pulled upward, thereby resisting accidental unlatching. To unlatch clips 24 once installed, the clips are rotated within holes 80 about pegs 76 by pressing handles 72 upward. This is most easily accomplished by placing the heels of both hands against the upper edges of the tray body near the clips and simultaneously pulling handles 72 upward with the fingers. The tray may also be removed with one hand by sequentially releasing and raising each end of the tray. As the clip handles 72 are pressed upward, pawls 82 are rotated out of the clip recesses 48 of the seat frame to release the tray from the seat and an outer lip 84 of spring plate 75 is pressed against a set of ridges 86 molded in the underside of tray body 66, elastically deflecting the spring plate. When the handle is released, this elastic deflection provides a restoring force that rotates the clip back to its recess-engaging position.

Figure 7:
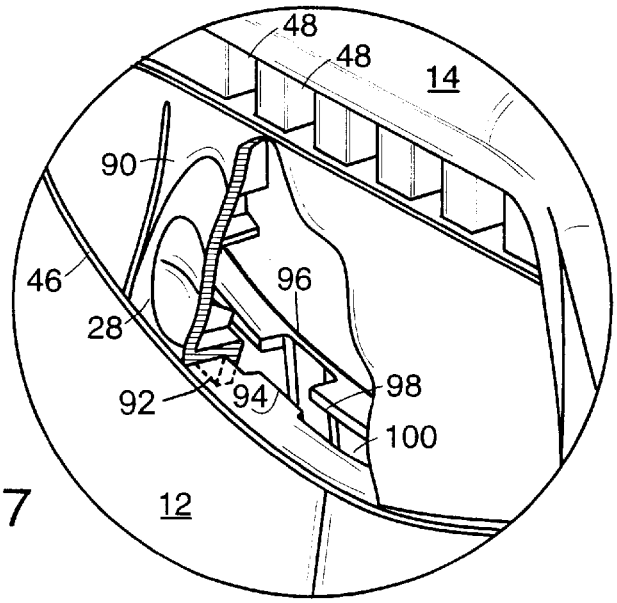
FIG. 7 is an enlarged view of area 7 in FIG. 3, with a portion of the side plate removed to show the structure of the tilt release mechanism.
Figure 8:
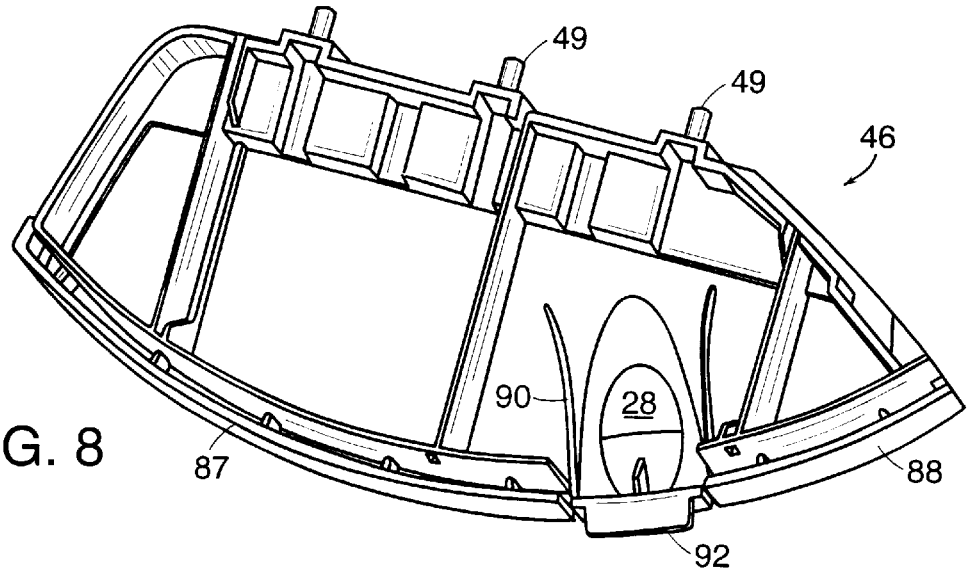
FIG. 8 is a perspective view of one of the side panels, viewed from its inner side.
Figure 9:
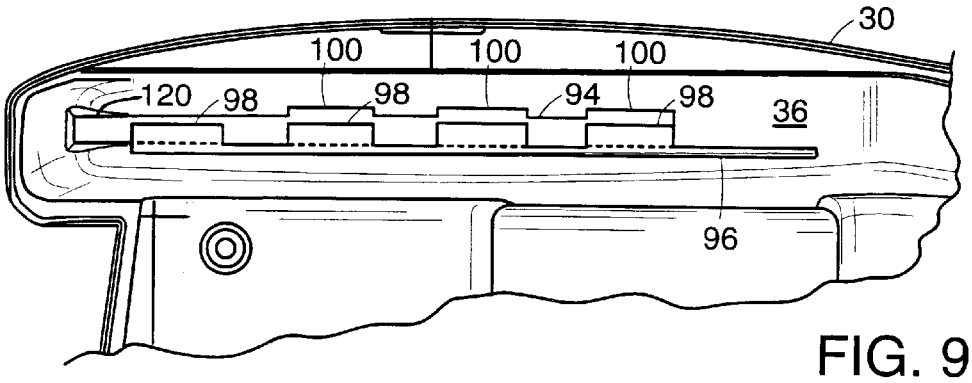
FIG. 9 is a top view of one of the base bulkheads, with extraneous material below the upper surface of the bulkhead removed.

FIGS. 7–9 show the structure of the tilt-release mechanism that releasably secures seat frame 14 in its reclined and upright positions with respect to base 12. As seen in FIG. 8, each side panel 46 has a curved bottom flange 87 with a lower surface 88 that is curved to follow an arc similar to the arc of the upper surfaces 36 of the base bulkheads 30 (FIG. 5), and which rests upon the base bulkheads to support the weight of the seat frame, tray and seated child during use. Flanges 87 extend inwardly when the side panels are assembled to the seat chassis to interlock with segmented flanges of the base bulkheads to retain the seat frame on the base. Tilt release button 28 consists of a cantilevered arm 90 integrally molded with the outer wall of side panel 46. The distal end of arm 90 includes an extending tab 92 for engaging one of a series of notches 100 along a corresponding slot 94 in the base (FIG. 9). As shown in FIG. 9, extending upwardly adjacent the inner edge of each slot 94 is a rib 96 with a laterally extending, curved flange 98 projecting outwardly in discrete segments from the upper edge of the rib. As the seat frame is initially rotated into place upon the base during assembly, the lower flanges 87 (FIG. 8) of the side panels are rotated underneath segmented flanges 98 to hold the seat frame on the base. Three discrete notches 100 contiguous with each slot 94 are provided for engagement by tabs 92 (FIG. 8) of the side panels to retain the relative rotation of the seat frame with respect to the base. A slot 120 through the front edge of each bulkhead provides clearance for the latching tabs of the side panels as the seat frame is initially rotated into position.

The illustrated feeding seat has been designed to minimize crevices and other areas where crumbs can collect and which increase cleaning effort. In addition, the entire seat can be dismantled to be placed in a dishwasher for cleaning. The seat, as shown, has no metal springs or pins or other small latch or hinge hardware that may be ingested by infants or that would require periodic lubrication or other maintenance. A presently preferred material for all molded parts shown is polypropylene.

Figure 10:
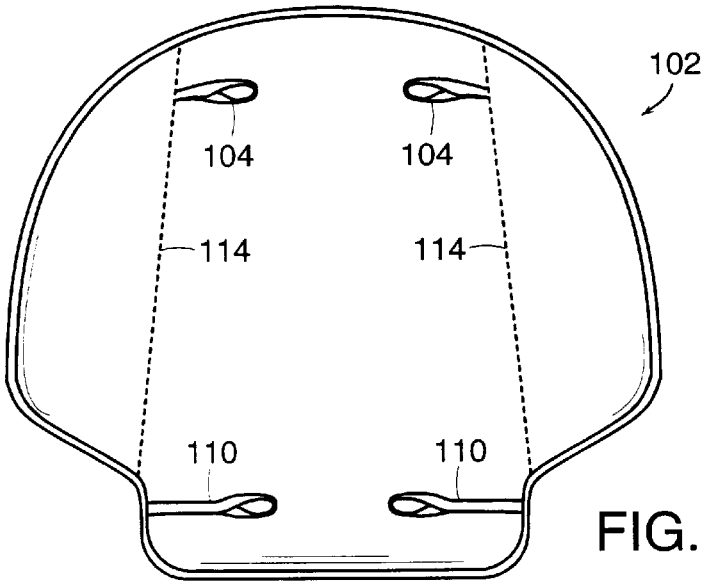
FIG. 10 illustrates an optional seat back cushion.

FIG. 10 shows a cushion 102 which is removably attached to provide padding on the back portion of the seat, as illustrated in FIG. 1. Referring also to FIG. 2, upper elastic loops 104 are inserted through upper back slots 106 and stretched over molded loop hooks 108. Lower elastic loops 110 are extended through lower back slots 26 to engage molded loop hooks 112. The body of the cushion preferably has an easily cleanable outer surface material, such as vinyl, with a piping perimeter. Alternatively, fabric materials, such as cotton, may be employed, such that the cushion can be removed and laundered. A layer of soft foam is a suitable cushion filler. The cushion is through-stitched along lines 114 to create fold lines.

Figure 11:
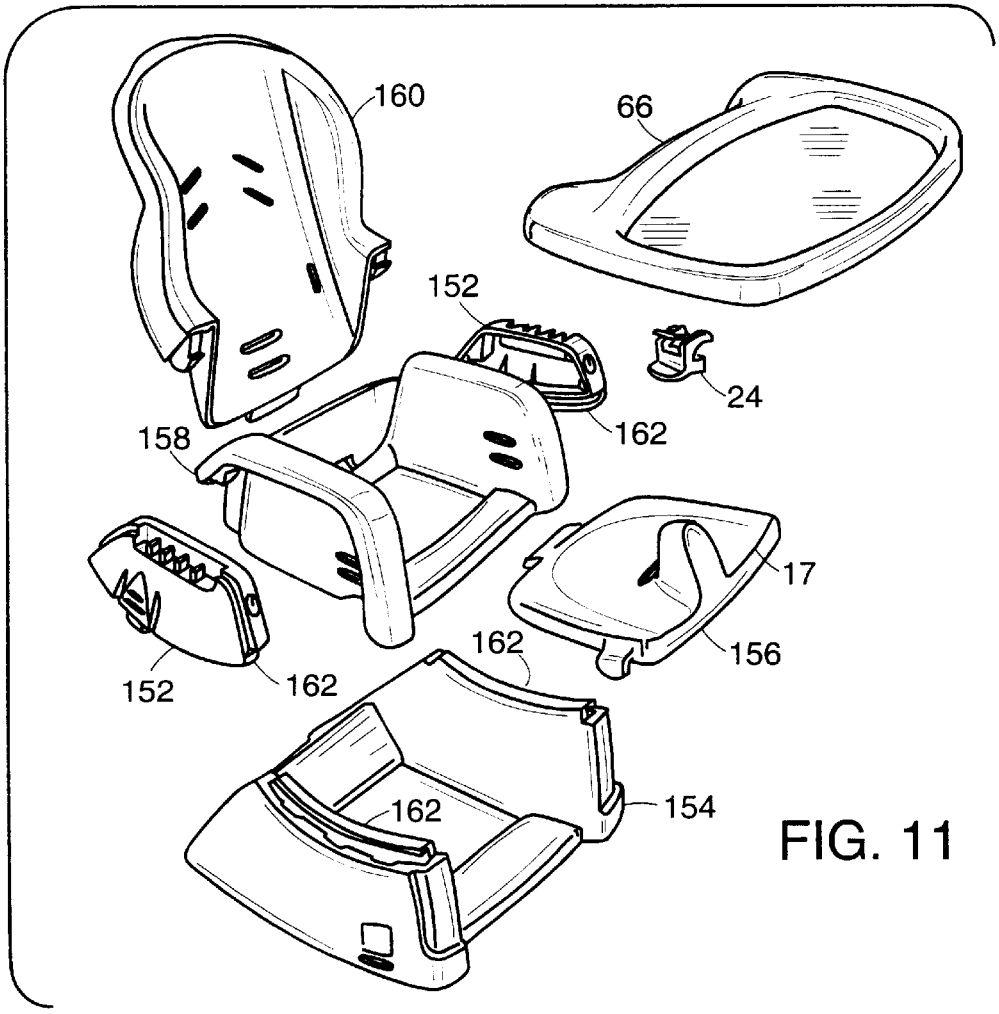
FIG. 11 is an exploded view of a second embodiment of the feeding seat.

FIG. 11 illustrates a second feeder seat embodiment 150. Noteworthy differences include the connection of the side panels 152 to the base 154, and the seat bottom 156 to the seat frame chassis 158 and the back 160. For instance, vertical connectivity between the seat frame and the base is accomplished in this embodiment by interlocking flanges 162 on the side panels and base. The tray body 66 and clips 24 are of similar construction to those of the first described embodiment.

Other embodiments are within the scope of the following claims. For instance, the seat may be equipped with an optional toy-carrying bar for entertaining and stimulating small children.

What is claimed is:

1. A child's feeding seat comprising a base having a bottom surface for supporting the seat upon a horizontal support;

a tiltable seat for holding a child, the seat having a seat frame with a back portion and a pair of side arms, the seat frame attached to the base in one of a series of selectable tilt positions, and a bottom portion attached to the seat frame at one of a series of selectable positions for adjusting the height of the bottom portion with respect to the back portion of the seat frame; and a feeding tray adapted to be removably attached to both of the side arms of the seat frame.

2. The feeding seat of claim 1 wherein the base includes a pair of spaced apart slots for receiving a strap to secure the seat base to said horizontal support.

3. The feeding seat of claim 1 wherein the bottom portion of the tiltable seat has a raised crotch restraint projecting from an upper surface thereof between the legs of a child seated in the seat.

4. The feeding seat of claim 1 further comprising a seat belt attached to the seat frame, for securing a seated child to the seat.

5. The feeding seat of claim 4 wherein the seat belt extends through a pair of slots defined in the back portion of the seat frame.

6. The feeding seat of claim 1 wherein the base and seat frame each have a pair of arcuate surfaces, the arcuate surfaces of the seat frame arranged to bear against the arcuate surfaces of the base with the seat frame in any of its selectable tilt positions.

7. The feeding seat of claim 6 wherein the seat frame comprises both a pair of flanges adjacent its pair of arcuate surfaces, and a movable tab extending from the seat frame; and wherein the base defines both a pair of arcuate channels for receiving the pair of flanges of the seat frame, and a slot for receiving the movable tab of the seat frame, the slot having a series of indentations for retaining the tab of the seat frame in any of a number of selectable locations along the slot for fixing the tilt position of the seat frame.

8. The feeding seat of claim 7 wherein the movable tab comprises a unitary molded plastic cantilever extending from the seat frame and adapted to be moved between base slot indentations by elastically bending the cantilever with respect to the seat frame.

9. The feeding seat of claim 1 wherein the feeding tray includes two clips, and wherein the side arms of the seat frame each define multiple recesses for receiving the clips of the feeding tray to retain the feeding tray in any one of a series of selectable positions with respect to the back portion of the seat frame.

10. The feeding seat of claim 9 wherein the clips are formed of molded plastic, each clip having a pair of raised pegs extending in opposite directions along a common axis, a manipulable handle, and a cantilevered spring portion extending from the clip to bear against the tray as the clip is pivoted about the pegs and to bias the clip toward an engaged position; and wherein the tray defines two pair of spaced apart apertures for receiving the pegs of the clips.

11. The feeding seat of claim 1 wherein the bottom portion of the pivotable seat has both a pair of ribs extending from opposite sides of the bottom portion, and a tab extending from a rear edge of the bottom portion, and wherein the side arms of the seat frame each define a series of selectable slots for receiving a corresponding one of the ribs of the bottom portion at differing bottom portion elevations; and wherein the back portion of the seat frame defines a series of selectable slots for receiving the tab of the bottom portion at differing bottom portion elevations.

12. The feeding seat of claim 1 wherein the tray has an upper surface that defines a broad recessed region bounded by a lip for intercepting spilled liquids.

13. The feeding seat of claim 1 wherein the seat frame, the base, the bottom portion and the tray are all formed of molded plastic.

14. The feeding seat of claim 1 wherein the bottom surface of the base is adapted to be supported upon a dining chair.

15. The feeding seat of claim 1 wherein the seat frame is attached to the base at a sliding interface, and is adapted to pivot with respect to the base about a pivot point which is disposed above the sliding interface.

16. A child's feeding seat comprising a base having a bottom surface for supporting the seat upon a horizontal support, the base defining a pair of spaced apart slots for receiving a strap to secure the seat base to said horizontal support; and a tiltable seat for holding a child, the seat having a seat frame with a back portion and a pair of side arms, the seat frame attached to the base in one of a series of selectable tilt positions, and a bottom portion attached to the seat frame at one of a series of selectable positions for adjusting the height of the bottom portion with respect to the back portion of the seat frame.

17. The feeding seat of claim 16 wherein the bottom portion of the tiltable seat has a raised crotch restraint projecting from an upper surface thereof between the legs of a child seated in the seat.

* * * * *